United States Patent [19]

Heath et al.

[11] 3,986,560

[45] Oct. 19, 1976

[54] FIRE PROTECTION MEANS

[76] Inventors: Richard Charles Heath, 3 Barham Close, Weybridge, Surrey; Harold William Gerald Wyeth, 5 Peatmoor Close, Fleet, Hampshire, both of England

[22] Filed: Sept. 26, 1974

[21] Appl. No.: 509,589

[30] Foreign Application Priority Data

Sept. 27, 1973 United Kingdom ..... 45396/73

[52] U.S. Cl. ..... 169/61; 169/62; 169/28; 340/227 R

[51] Int. Cl.[2] ..... A62C 3/08

[58] Field of Search ..... 169/62, 28, 26, 60, 169/61; 310/8.7; 340/224, 227 R, 192

[56] References Cited

UNITED STATES PATENTS

| | | | |
|---|---|---|---|
| 2,693,240 | 11/1954 | Glendinning et al. | 169/62 X |
| 2,808,114 | 10/1957 | Parker, Jr. et al. | 169/28 X |
| 2,815,819 | 12/1957 | Marshall | 169/62 X |
| 3,523,583 | 8/1970 | Poitras et al. | 169/28 |
| 3,604,511 | 9/1971 | Griffith et al. | 169/28 |
| 3,713,491 | 1/1973 | Grabowski et al. | 169/28 X |
| 3,825,766 | 7/1974 | Connor et al. | 169/62 X |

FOREIGN PATENTS OR APPLICATIONS

| | | |
|---|---|---|
| 846,221 | 8/1960 | United Kingdom |

*Primary Examiner*—John J. Love
*Assistant Examiner*—Michael Mar
*Attorney, Agent, or Firm*—Nolte and Nolte

[57] ABSTRACT

A fire protection apparatus, particularly for liquid fuel containers which are carried in aircraft or other vehicles, comprises a pressure transducer for producing an electrical output upon sensing a pressure change of predetermined magnitude in a liquid, a source of fire extinguishant, an actuator for discharging the fire extinguishant from the source of fire extinguishant, and a self-energized repeater adapted to respond to the output of the pressure transducer and to generate a signal for operating the actuator to discharge fire extinguishant from the source.

18 Claims, 16 Drawing Figures

A
E
B
D1D2
C
31
32
33
34
35
36
37
11
12
13
14
15
16
17
18
19
20
21

1
2
3
4
5
6
7
8
11
12
13
14
15
16
17
18
19
20
21
A
B
C
D1
D2
E

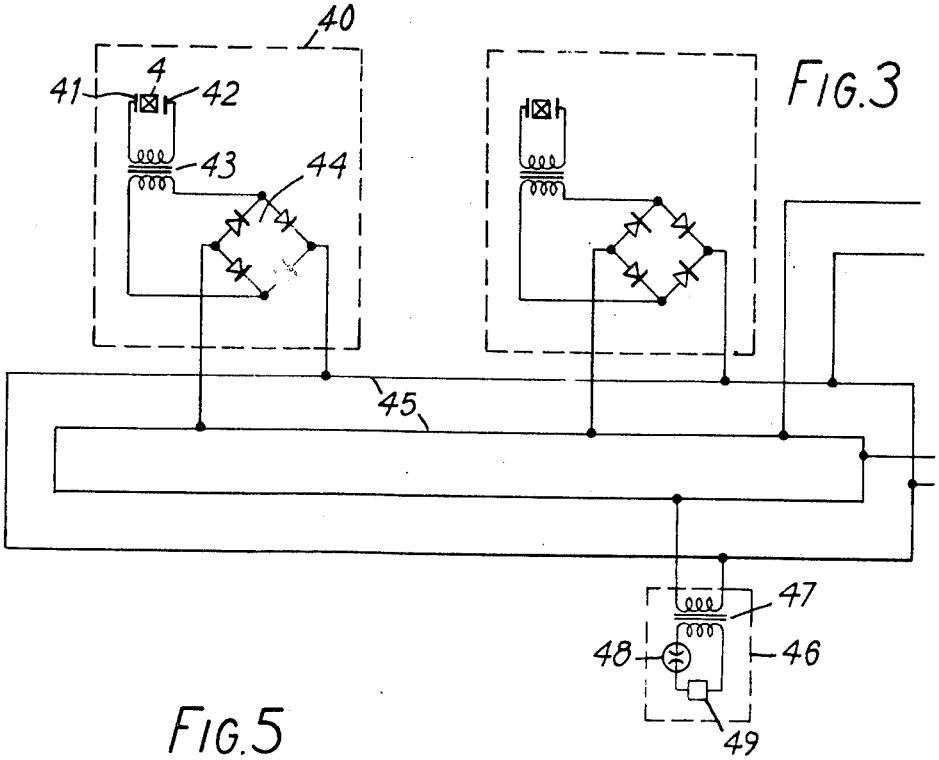
FIG. 3
FIG. 5
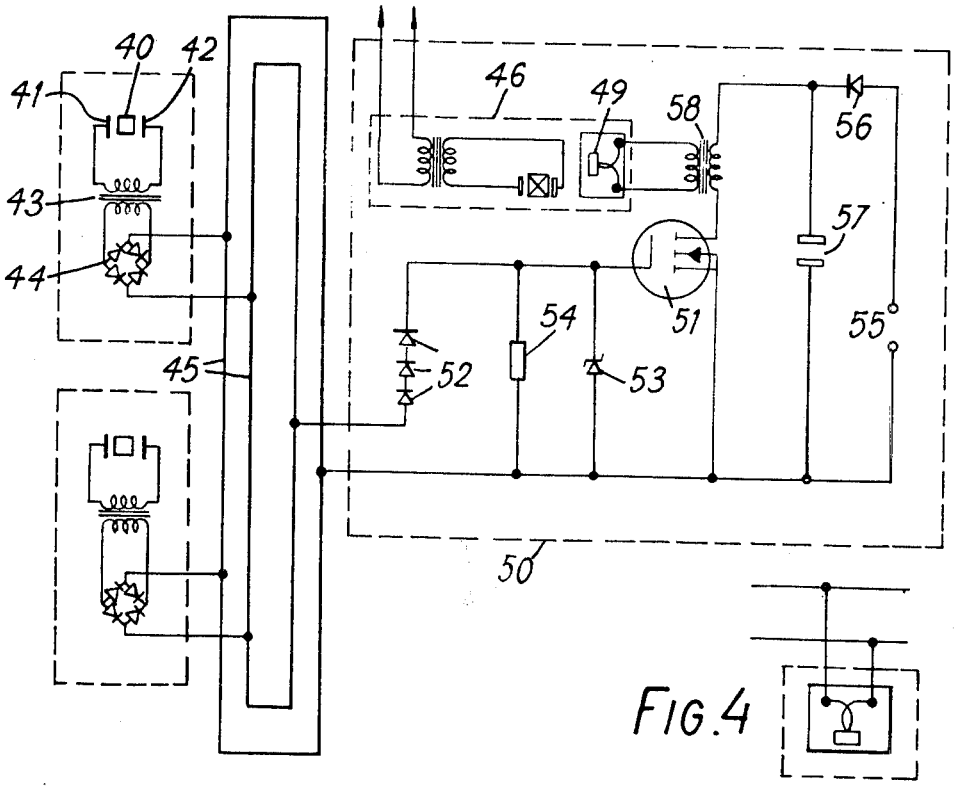
FIG. 4

FIRE PROTECTION MEANS

BACKGROUND OF THE INVENTION

1. Field of the Invention

The present invention relates to fire protection apparatus, particularly for use with liquid fuel containers such as tanks or conduit pipes of aircraft, other vehicles or stationery installations, and which are liable to be ruptured by projectiles or impact.

2. Description of the Prior Art

It has previously been proposed to provide a fire extinguishing system for protecting the fuel tanks of aircraft, for example, by providing in the fuel tank a pressure transducer for actuating a fire extinguisher in the event of the occurrence of increased pressures indicating the puncture of the fuel tank by a projectile. Such a system has not become a practical reality, however, since the systems heretofore proposed have essentially been dependent for their operation upon the power supply of the aircraft and also have incorporates extensive electrical circuitry that itself is vulnerable to projectiles directed at the aircraft. In the event of failure of the aircraft power supply or interruption of the electrical circuit of the system, the system would become inoperative, and such a system has not therefore proved acceptable for practical use.

SUMMARY OF THE INVENTION

It is an object of the present invention to provide fire protection apparatus which can meet the general aircraft requirements of small size and low weight and can also meet the specific requirement of very high speed operation while incorporating the desirable feature of being self-powered.

The present invention provides fire protection apparatus comprising a pressure transducer adapted to produce an operative electrical output upon sensing a predetermined pressure change in a container of flammable liquid, a source of fire extinguishant, a repeater comprising a source of stored energy adapted to be released by said electrical output, and an actuator adapted to be operated by the energy released from said repeater to effect discharge of fire extinguishant from said source to resist combustion of said liquid.

Advantageously, the said repeater comprises a detonator and an associated transducer arranged to be energised by said detonator.

The detonator may comprise a fuse device of the type known as a "bridge head" or "match head" which includes a small quantity of lead azide, and which requires an energy of only 100 or so micro joules for actuation. In the case of spark-gap detonators it may be desirable to arrange a further gap in series to prevent degradation of the explosive material. The detonator may, however, be an RDX explosive or a heat or gas discharge device.

A transducer for incorporation in the fire protection apparatus according to the invention may comprise a piezo-electric material such as ferro-electric, ceramic, crystal or other material (hereinafter referred to as a piezo-electric material) or a magneto-strictive material, immersed in the liquid in the container, or mounted on the wall of the container in such a manner as to receive sudden pressure changes or shock waves from the liquid. If the piezo-electric or magneto-strictive material is to be located in the liquid it may be multi-directional, and may be a hollow ball of piezoelectric ceramic or a hollow cylinder with sensing means facing in more than one direction.

According to a preferred embodiment of the invention, the pressure transducer comprises a pair of axially polarized piezo-electric elements arranged end-to-end along their axis of polarization with a common electrode therebetween and further electrodes in contact with their free ends, said elements being located within a housing so constructed that pressure changes externally of said housing cause a change in the axial stress upon said piezo-electric elements whereby a voltage is produced across the respective electrodes in contact with each element. With piezo-electric elements arranged end-to-end, it is preferred to have like poles in contact with one another, i.e. in an electrically parallel arrangement, so that an even number of elements can be mounted in a metal chamber without the need for electrically insulating either end of the stack. The absence of insulation allows a maximum length of piezo-electric material to be accommodated in a chamber of given size and also avoids energy absorption by an insulator. With this arrangement the said further electrodes may be electrically connected together via said housing. According to a preferred arrangement said housing is adapted for immersion in said liquid and comprises a rigid open-ended tubular portion extending axially around said piezo-electric elements, the open ends of said tubular portion being closed by flexible diaphragms in electrical and pressure contact with said free ends of said piezo-electric elements. The transducer may further comprise pressure intensifier studs arranged between said diaphragms and said piezo-electric elements, said studs being formed of electrically conductive material and having surfaces of larger surface area in contact with said diaphragms and surfaces of smaller surface area in contact with said piezo-electric elements and serving as said further electrodes. Such an arrangement improves the potential output of the transducer by increasing the loading on the piezo-electric material.

It is possible that signals of potential similar to that produced in emergency conditions will be derived in the transducer due to routine pressure changes in an aircraft fuel tank due to aircraft acceleration or temperature change. Such signals may also be produced by pyro-electric effects which may be provided if the poled transducer material is exposed to the substantial temperature changes which can occur in aircraft fuel tanks. To prevent unwanted response of the system to such signals a signal filter such as a transformer and/or a spark-gap device, may be employed to restrict transmission of signals to those of the nature generated by an emergency shock in the liquid. This danger can also be overcome by employing a leak resistor across the transducer output, or alternatively the specific resistance of the transducer elements may be of the appropriate magnitude, as could be achieved by uranium doping of the material.

Depending upon the design requirements of a given fire protection installation, it may be desirable, in a fire protection apparatus according to the invention, for a plurality of said transducers to be arranged in parallel to feed a common repeater. In this case the transducers are preferably arranged in parallel on a ring circuit, in order to reduce the chance of interruption of the circuit due to severing of the conductors. In order to enable each transducer to provide the maximum output to the said ring circuit, the transducer is preferably connected to said ring circuit via a diode rectifier bridge circuit, so that said transducers are isolated from one another.

According to one embodiment of the invention, amplifying means are provided for amplifying the operative electrical output of the pressure transducer. Preferably said amplifying means comprises an electronic switch of the type which remains non-conductive in the absence of a signal at a gate electrode thereof, and means for retaining a charge in a circuit including said electronic switch and the or each said repeater, the said electronic switch being arranged to be triggered to a conductive state by an output from said transducer which exceeds a predetermined threshold value. The said electronic switch may comprise an enhancement field effect transistor. Preferably said charge retaining means comprises a storage capacitor connected to a power source via an isolating diode. By means of this arrangement, effective amplification of the signal from the pressure transducer is provided to take account of lack of sensitivity, for example to penetration of the tank by low energy fragments, or if the tank is a very shallow one with a large surface area such as that contained in an aerofoil of a supersonic aircraft. Furthermore, owing to the fact that the power required for the amplifier may be derived solely from a storage capacitor previously charged by means of a power source from which it is isolated, the system remains operative even in the event of severing of a power supply cable of the aircraft. Also the system permits the power supply to have a sufficiently high impedance to prevent generation of sparks upon severing of the cable. Moreover, the system is protected from false operation owing to noise pulses occurring on the aircraft power supply. Although the amplifier does require an initial power supply to charge the storage capacitor, the fact that the circuit requires no standing current places a minimum requirement on the power source so that this may be supplied by a self contained primary or secondary cell of miniature size. The circuit also remains effective in the event of failure of the power supply such as may occur at extreme low temperatures during high altitude flight.

A repeater for incorporation in the apparatus according to the invention may comprise a plurality of detonators each arranged for connection to the output of a corresponding transducer and all arranged, when fired, to act upon a common transducer to provide an output signal. The repeater may further comprise a plurality of ferro-electric elements arranged end-to-end between a pair of electrically connected electrodes, a contact connected to a junction between adjacent ones of said ferro-electric elements whereby upon axial compression of said elements an output signal is generated between said electrodes on the one hand and said contact on the other hand, and a detonator so arranged adjacent each electrode that upon firing of each of said detonators the ferro-electric elements are subjected to axial compression. In order to ensure that each detonator is independently actuatable and unaffected by the actuation of the other detonator, preferably each of said electrodes of said repeater comprises a frusto-conical disc of which the wider part is in contact with a corresponding one of said ferro-electric elements and the conical part engages a mating seating restraining said disc from axial movement away from the adjacent ferro-electric element, whereby each disc is capable of axial movement away from its seating by the adjacent detonator to effect compression of said ferro-electric elements, but resists axial pressure due to movement of the opposite disc.

A fire extinguisher for incorporation in the apparatus according to the invention may comprise a generally cylindrical container containing extinguishant, an actuator arranged at one end of said container and comprising a detonator and gas generator for pressurising said container in response to a signal from the or a said repeater, and a frangible diaphragm, closing the other end of said container. The diaphragm may be arranged to be ruptured by the gas pressure generated within said container, or by a further detonator, to discharge the contents. Preferably said fire extinguisher further comprises a flexible membrane for containing gas generated by said gas generator at least during initial pressurisation of said container.

The extinguishant may be a gas, e.g. nitrogen, carbon dioxide, etc., or a powder such as potassium or sodium carbonate, potassium cryolite, or ammonium phosphate. The powder would preferably contain a dispersant additive such as micronised hydrophobic silica. The preferred extinguishant is, however, a low boiling point liquid such as bromotrifluoromethane (BTM) or bromochlorodifluoromethane (BCF) or a mixture of the two. The extinguishant may be discharged into the tank in addition to or as an alternative to discharge into cavities.

Fire protection apparatus in accordance with a preferred embodiment of the invention may be particularly suitable for mounting on the outside of fuel (or other flammable liquid) tank walls in aircraft bays adjacent to such tanks, (e.g. in the leading edge or trailing edge wing compartments) when such bays are liable to flooding by the contents of the fuel tank if the tank wall is ruptured by a projectile or other impact. Alternatively, the apparatus including the source of extinguishant may be inserted inside the tank to discharge the extinguishant into the tank ullage. The shock of such rupture is severe at the location of penetration, and an impact will be transmitted through the liquid fuel to the transducer so that the latter will generate a signal which will operate the detonator to burst the wall of the extinguishant container and disperse the extinguishant. It should be emphasized that the response time of the apparatus is very short, being of the order of milliseconds, so that the dispersal of the extinguishant is effective suppress any fire before it becomes established. However, it will be appreciated that a delay in the response time may be built into the system should this be required for any purpose, for example to take account of penetration of the fuel tank by particular types of explosive ammunition.

The fire protection apparatus according to the invention is capable of versatile operation of strategically placed fire extinguishers to maximum effect, and one example of a system according to the invention comprises a plurality of fire extinguishers arranged in groups in the vicinity of a plurality of adjacent containers of flammable liquid, each group of extinguishers being capable of prevention of fire in or adjacent at least one of said containers, a repeater individual to each group, for operating all the actuators of said group, and one or more transducers associated with each container and each arranged to operate a repeater individual to a group of extinguishers adjacent the corresponding container.

A repeater of a group of extinguishers adjacent a given container may also be arranged to operate a repeater of a further group of extinguishers adjacent the same container, for example where the number of extinguishers adjacent said container is too many for actuation as a single group by one repeater, or where the further group of extinguishers is also capable of prevention of fire in another adjacent container and may require separate actuation in the event of penetration of the latter container by a projectile. In the latter case the repeater individual to said further group may also be arranged to be operated by a transducer associated with said other adjacent container.

If desired, a transducer of a fire protection apparatus as referred to above may be arranged so that it is capable of operation more than once for repeat actuation of fire extinguishers upon sensing further shocks in the liquid fuel in addition to that which initially actuates the system. To provide for this, for example, the output of a repeater initially actuated by the transducer may be arranged to actuate a changeover switch in the circuit of the transducer so that the latter is rendered capable of actuating a further extinguisher or group of extinguishers upon production of a further output signal. The changeover switch may take the form of an explosive switch of known type, or may be in the form of an electric circuit including fusible links which open or close current paths in response to a current passing therethrough, so that the circuit provides a plurality of different, consecutively available current paths.

The actuating circuit of a fire protection apparatus according to the invention is also capable of adaptation to various requirements, for example when incorporated in an aircraft it may be rendered subject to manual override by a pilot, it may be adapted to receive input signals in addition to those from the transducer or transducers, for example from a crash switch, and it may be adapted to provide output signals to devices in addition to the fire extinguisher or extinguishers, for example to explosive actuators for emergency switch-off of aircraft functions which provide a fire hazard.

BRIEF DESCRIPTION OF THE DRAWING

The invention is illustrated by way of example in the accompanying drawings in which:

FIG. 3 is a circuit diagram of part of a fire protection apparatus according to a further embodiment of the invention, FIG. 4 is a circuit diagram illustrating a modification of the arrangement shown in FIG. 3, FIG. 5 is a circuit diagram of a further embodiment of fire protection apparatus according to the invention.

DETAILED DESCRIPTION

Figures 1, 2:
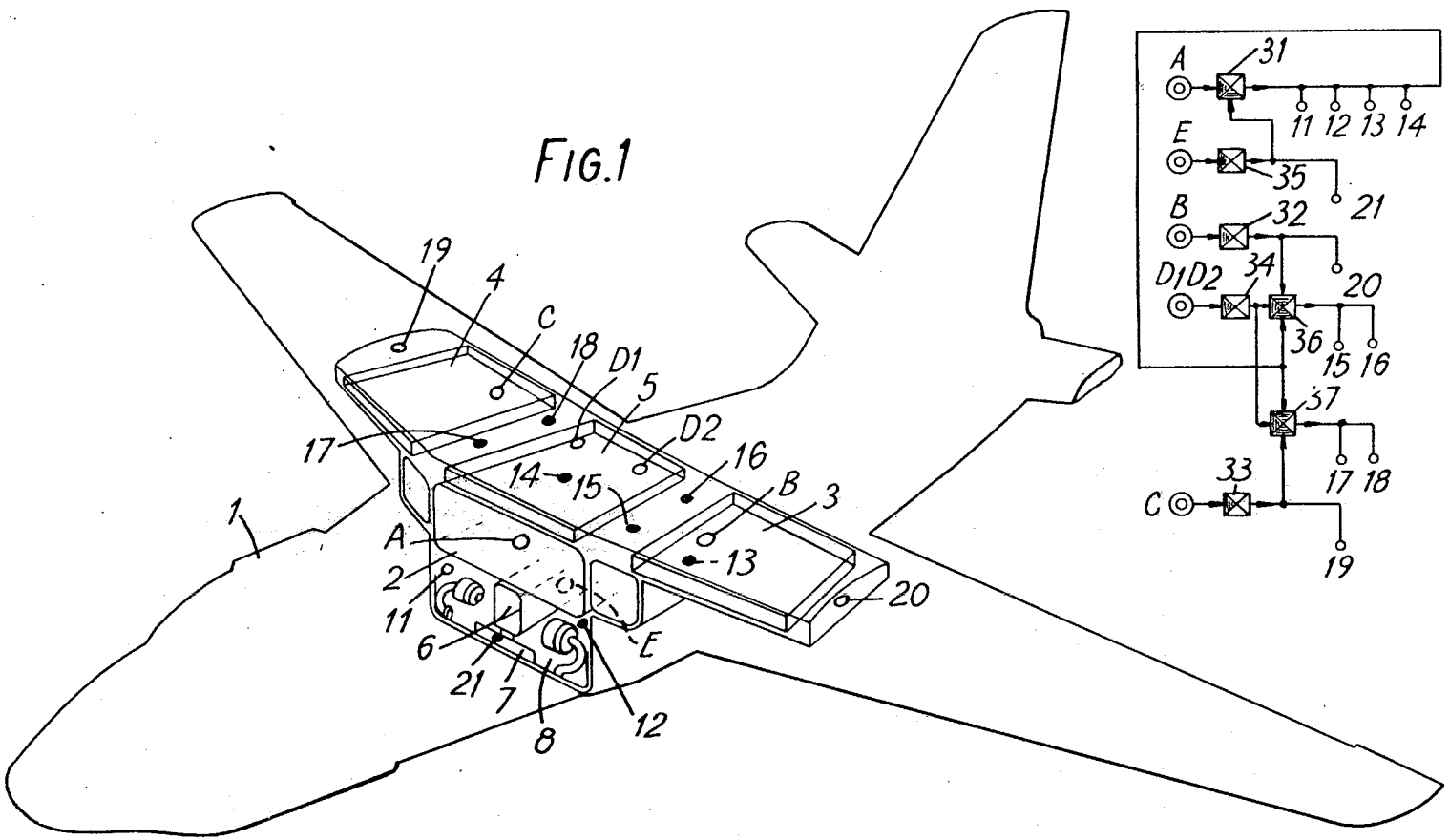
FIG. 1 is a diagrammatic perspective view showing the general arrangement of a fire protection apparatus according to the invention as applied to the fuel tanks of a military aircraft.
FIG. 2 is a circuit diagram of the arrangement shown in FIG. 1.

Referring to FIG. 1 of the drawings, a military aircraft 1 of conventional lay-out incorporates a plurality of fuel tanks distributed therein, for example a main fuselage tank 2, wing tanks 3 and 4, an upper fuselage tank 5, and a lower fuselage tank 6. Between the fuel tanks and the airframe of the aircraft, air spaces are left to accommodate auxiliary components of the aircraft as is conventionally the case, for example a service duct 7 and an under carriage compartment 8. Within these air spaces adjacent the fuel tanks, there are provided a plurality of fire extinguishers indicated diagrammatically at 11 to 21, and actuatable by transducers A to E arranged to respond to a pressure wave occurring within the liquid fuel contained by a fuel tank, when the tank wall is ruptured by a projectile or other impact.

Referring now to FIG. 2, each of the transducers is arranged to actuate a repeater unit indicated diagrammatically by squares 31 to 37, the hatched portions of the square indicating inputs and the unhatched portions indicating outputs. The transducers A to E, and the extinguishers 11 to 21 are strategically placed within and around the fuel tanks of the aircraft, and are so interconnected by the repeaters 31 to 37 that they form a logical circuit such that actuation of a transducer associated with a given fuel tank will actuate those extinguishers most suitably placed to prevent a fire within the corresponding tank. Thus, in the event of rupture of the main tank 2, the transducer A associated therewith will provide an output signal to repeater 31, which will in turn actuate the fire extinguishers 11 to 14 arranged within the under carriage compartment immediately below the main tank 2. The output from the repeater 31 will also actuate repeaters 36 and 37 to actuate the extinguishers 15 to 18 arranged within bays on each side of and above the main tank 2. In the event of a puncture of either of the wing tanks 3 or 4, the associated transducer B or C will provide an output to the repeater 32 or 33, to actuate the extinguisher 19 or 20 in the wind bay. In addition, by way of the repeater 36 or 37, the extinguishers 15 and 16, or 17 and 18, in the bay adjacent the inner end of the wing tank are also actuated. In the event of puncture of the upper fuselage tank 5, either or both of the transducers D1 and D2 will provide an output to the repeater 34 which will in turn actuate repeaters 36 and 37 to actuate all of the extinguishers 15 to 18 within the bays surrounding the upper tank 5. In the event of a puncture of the lower fuselage tank 6, the transducer E will actuate repeater 35 to actuate the extinguisher 21 within the services duct immediately therebelow, and the repeater 35 will also provide an output to repeater 31, so that all of the extinguishers 11 to 18 will be actuated as in the case of a puncture of the main tank 2.

Each of the transducers A to E comprises a piezo-electric or magneto-strictive pressure transducer arranged to produce an electrical output signal in response to a pressure wave within liquid fuel contained in the associated fuel tank, and each of the repeaters 31 to 37 comprises a self-powered device arranged to produce an amplified electrical signal, without the requirement for external power supplies, in order to actuate a plurality of fire extinguishers, and/or further repeaters. In this manner, the complete fire protection system is rendered independent of the aircraft power supplies, and is therefore capable of operating reliably even in the case of failure of the aircraft power supply. Even in the event of interruption of part of the circuit of the fire protection system itself, the system may still be capable of effective operation, as will be described in more detail below.

Referring now to FIG. 3, there is shown a circuit diagram of an arrangement enabling the use of a plurality of transducers in a common circuit, whilst maintaining the maximum output signal from each transducer. Such a circuit is suitable, for example, in the case of the two transducers D1 and D2 referred to above which are provided in a common tank and are arranged to actuate a single repeater. As shown diagrammatically in FIG. 3, each transducer comprises a body 40 of piezo-electric material, to which are connected a pair of electrodes 41 and 42, the arrangement of the piezo-electric material with respect to the liquid in a fuel tank being such that the stress applied to the piezo-electric material by a pressure wave occurring in the fuel tank is such as to cause a voltage to be applied across the electrodes 41 and 42 as a result of the piezo-electric effect. The electrodes 41 and 42 are connected to the primary winding of a pulse transformer 43, and the secondary winding of the transformer is connected to a diode bridge rectifier 44. The outputs of the diode bridge rectifiers 44 associated with the respective transducer units are connected in parallel, the arrangement being such that the output from each transducer is isolated from the circuit of each other transducer by means of the diode bridge of the other transducer. In this manner, each transducer is rendered capable of producing the maximum output signal, without reduction of the signal owing to the capacitance of any other transducer connected in parallel therewith. The outputs of all the transducers connected in parallel are connected in a ring circuit by means of conductors 45, so that in the event of severing of a conductor 45 at any one point in the circuit, for example by means of a projectile or a fragment thereof, the conductor 45 would still be capable of providing an output from the transducer to a corresponding repeater unit. As shown in FIG. 3, a repeater unit 46 connected to the outputs from the respective transducers comprises a pulse transformer 47, the primary winding of which is connected to the conductors 45 and the secondary winding of which is connected via a spark gap 48 to a detonator 49. The spark gap 48 serves as a filter for preventing unwanted signals from the transducers below a given voltage from actuating the detonator 49. Such signals might, for example, be generated by routine pressure changes in an aircraft fuel tank due to aircraft acceleration or temperature change. On the other hand, when the output signal from the transducers is of a sufficient magnitude to indicate penetration of the tank by means of a projectile, the voltage will produce arcing across the spark gap 48 and actuate the detonator 49. The detonator 49 serves to produce a further electrical signal from the repeater unit, for example by actuation of a further piezo-electric generator as described in more detail below. If desired, the detonator 49, instead of being a voltage operated detonator, may be a current operated detonator, in which case the pulse transformer 47 and the spark gap 48 may be omitted, and the detonator connected directly to the conductors 45 as indicated in FIG. 4.

Refering now to FIG. 5, there is shown a circuit arrangement for increasing the sensitivity of a transducer. Such an arrangement may be required, for example, where a fuel tank is relatively shallow, and/or in the case where the tank is relatively large and transducers are relatively widely spaced, so that the length of the path of a projectile in passing through the tank is relatively short, or the shortest distance between the transducer and the path of the projectile is relatively large. In either case a more sensitive transducer will be required in order to produce a sufficient output to actuate a repeater. In view of the increased sensitivity of the transducer provided by this circuit, the transducer should be appropriately constructed so that it is pressure sensitive, but is not sensitive to forces thereon due to acceleration of the aircraft. Components of FIG. 5 which correspond to those of FIG. 3 are indicated by the same reference numerals, and a further description will therefore be omitted. In the case of the circuit of FIG. 5, the conductors 45, instead of being connected directly to the repeater, are connected to the detonator 49 of the repeater via an amplifier circuit 50. The amplifier 50 comprises an enhancement type field effect transistor 51 which has a positive threshold value and is therefore capable of maintaining a charge across its drain and source electrodes without drawing any drain current, in the state where no signal is applied to the gate electrode. The conductors 45 of the transducer circuit are connected respectively to the source electrode of the field effect transistor 51, and to the gate electrode thereof via a plurality of series connected silicon diodes 52. A Zener diode 53 is connected between the gate and the source of the field effect transistor 51 in order to provide a low impedance path for signals of a polarity tending to turn off the field effect transistor, whilst providing a predetermined maximum threshold level for signals of a polarity that turn on the transistor. A resistor 54 is connected in parallel with the Zener diode 53, in order to provide for matching of the circuit to the transducer circuit. The source and drain of the field effect transistor 51 are connected to a power supply 55 by way of an isolating diode 56, and in addition a charge storage capacitor 57 is connected in parallel with the current path of the field effect transistor 51, between the isolating diode 56 and the transistor 51. In addition, the primary winding of a pulse transformer 58 is connected in series in the current path of the field effect transistor 51, the secondary winding of the transformer 58 being connected to the detonator 49. The operation of the circuit is as follows. In the idle condition of the circuit the capacitor 57 becomes charged from the power supply 55 by way of the diode 56. The capacitor 57 is preferably a tantalum capacitor capable of storing energy of a quarter to half a joule at a potential of the level of 15 to 20 volts, and has a very low leakage so that the charge can be stored for some considerable time in the event of failure or temporary interruption of the power supply 55. In the idle condition of the circuit no signal is applied to the gate of the transistor 51, and therefore the latter is in a non-conductive state and the charge is retained by the capacitor 57. The series connected silicon diodes 52 provide a threshold level preventing noise signals produced from the transducer circuit by aircraft vibration, for example, from influencing the field effect transistor 51. In the event of a high voltage signal from the transducer circuit passing the diodes 52 and reaching the threshold value of the transistor 51, the latter will become conductive and the charge from the capacitor 57 will discharge through the transistor 51 and the primary winding of the transformer 58. The corresponding signal in the secondary winding of the transformer 58 will actuate the detonator 49. It will be appreciated that since the capacitor 57 is capable of storing a charge for a considerable time, the transducer circuit will still operate reliably even in the event of failure of the power supply 55, for example due to interruption of the aircraft power supply or to temporary failure of a storage battery owing to extreme low temperature conditions.

Although the amplifier 50 is shown connected to a repeater unit, it will be appreciated that if the capacitor 57 was of sufficient size it could itself act as a store of energy for operating the actuator of one or more fire extinguishers, so that the amplifier 50 would in this case serve as the repeater. In practice, however, it will be more convenient to provide an explosive repeater incorporating the detonator 49.

Figure 6:
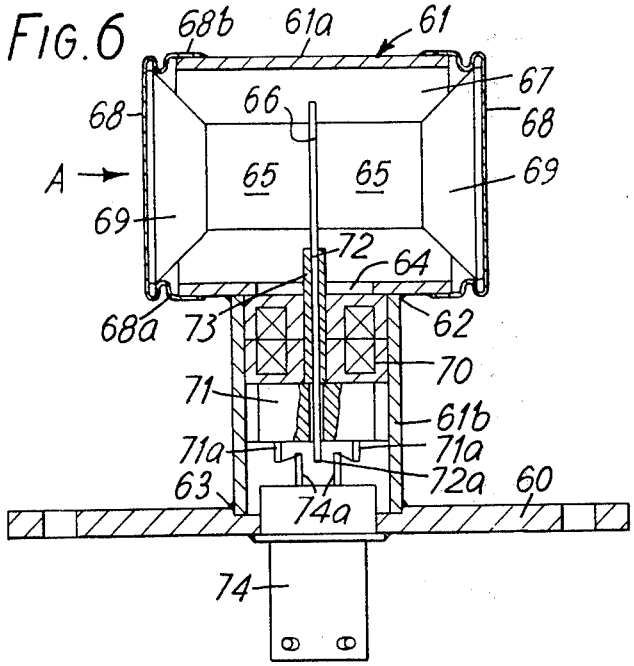
FIG. 6 is a sectional elevation of a transducer and associated circuit elements for incorporation in the circuit shown in FIG. 3 or FIG. 5.
Figure 7:
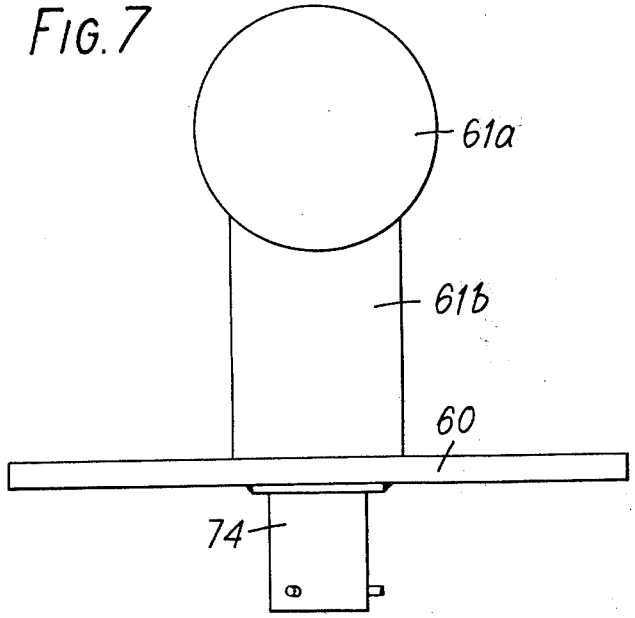
FIG. 7 is a side elevation of the transducer shown in FIG. 6, in the direction of the arrow A.

FIGS. 6 and 7 show one embodiment of transducer unit for example for incorporation in a circuit as shown in FIG. 3 or FIG. 5. The transducer unit is arranged to be immersed within the liquid fuel within an aircraft fuel tank, and for this purpose comprises a base member 60 to be bolted to the base of a fuel tank, and a transducer body 61 arranged to project upwardly through an aperture in the wall of the fuel tank and into the body of liquid fuel container therein. The body 61 comprises an upper cylindrical portion 61*a* arranged with the axis of the cylinder generally horizontal, and a lower cylindrical portion 61*b* arranged vertically. The cylinders 61*a* and 61*b* are welded together at 62, and the cylinder 61*b* is welded to the base member 60 at 63. The wall of the cylinder 61*a* has a circular aperture 64 communicating with the interior of the member 61b. Within the cylinder 61*a* are mounted two cylindrical piezo-electric ceramic elements 65, the elements being located in spaced relation to the wall of the cylinder 61*a* by means of a highly compliant potting compound 67. Between the two elements 65 is arranged an electrode disc 66. The ends of the cylinder 61*a* are closed by means of metallic diaphragm 68 having peripheral convolutions 68*a* to facilitate flexing of the diaphragm in a direction parallel to the axis of the cylinder 61*a.* The diaphragms 68 have cylindrical flange portions 68*b* by means of which they are welded to the ends of the cylinder 61*a.* Between the diaphragm 68 and the piezo-electric elements 65 are arranged frusto conical pressure intensifier studs 69, the wider ends of the studs being located within the peripheral recesses defined by the convolutions 68*a* at the end wall of the diaphragms 68, and the narrower ends of the studs 69 being held firmly in engagement with the piezo-electric elements 65. The elements 65 are likewise held in firm contact with the electrode 66. Within the cylindrical portion 61*b* of the transducer are mounted an encapsulated pulse transformer 70, corresponding to the transformer 43 referred to above, and an encapsulated diode bridge 71, corresponding to the diode bridge 44 referred to above. A wire conductor 72 is soldered to the electrode disc 66, and extends through mounting apertures normally provided in the transformer 70 and the bridge 71, to provide a wiring terminal 72*a* at its free end. The conductor 72 is insulated from the core of the transformer 70 by means of an insulating sleeve 73. The piezo-electric elements 65, the transformer 70 and the diode bridge 71 are connected in a circuit of the configuration shown above in FIGS. 3 and 5, and for simplicity the wiring is not shown in detail in FIG. 6. Briefly, however, the two piezo-electric elements 65 form parallel connected transducers of which the disc 66 forms one electrode, and the studs 69 form the other electrodes. The circuit of the transducer is completed on the one side by the conductor 72, and on the other side by the conductive path between the stud 69, the diaphragm 68, the cylinder 61*a*, and the cylinder 61*b*. Thus the respective terminals of the primary winding of the transformer 70 are connected respectively to the terminal 72*a* and the wall of the cylinder 61*b*. Although not shown in detail in the drawing, the transformer 70 and the diode bridge 71 comprise peripheral axial grooves, providing axial wiring passages through which the respective connecting wires can extend to the appropriate components. The base member 60 of the transducer unit incorporates a hermetically sealed two pin output connector 74 mounted therein, terminals 74*a* of the connector 74 being wired to corresponding output terminals 71*a* of the diode bridge 71. The connector 74 provides a convenient connection by means of which the transducer unit may be connected via conductors corresponding to the conductors 45 above, to a repeater unit to be described in more detail below.

The operation of the transducer unit described above is briefly as follows. In the event of a projectile penetrating the wall of a fuel tank within which the transformer is immersed, or in the event of other serious impact, the resultant shock waves in the fuel will be transmitted to the diaphragm 68, and thence via the pressure intensifier studs 69 to the piezo-electric elements 65. The elements 65 are polarized along an axis parallel to the axis of the cylinder 61*a*, and thus when compressed by such a pressure wave they produce a voltage between the electrode 66 and each of the studs 69. This voltage is transmitted via the transformer 70 and the bridge 71 to the output terminals of the connector 74. The material chosen for the elements 65 should of course be such that a signal of sufficient charge is derived in response to a pressure wave caused within the liquid fuel by means of a projectile, and it has been found in practice that commercially available piezo-electric ceramics such as "Vernitron" PZT-5A and/or PZT-7A (lead zirconate titanate) and Admiralty Materials Laboratory 1073 are capable of providing an adequate signal. However, a wide variety of suitable materials are available to meet given requirements and operating conditions. In some circumstances it may be found desirable to pre-stress the piezo-electric elements during assembly of the transducer so that the elements are caused to operate on the most advantageous point of the characteristic pressure response curve of the material. Also, materials may be chosen which initially provide a high charge output but which lose their sensitivity after initial heavy stresses. In a system according to the present invention such a material may be preferable to one having more stable characteristics but a lower sensitivity.

The energy derived from a transducer as described above, except in particular circumstances such as referred to above with reference to FIG. 5, will generally be sufficient to fire a detonator without further amplification. However, as described above with reference to FIG. 1, it may be desired for a single transducer to fire the detonators of a plurality of fire extinguishers connected together as a group, either in parallel or in series. The signal from a transducer alone would not be sufficient to do this, and therefore in accordance with one feature of the present invention there is provided a repeater which responds to the output of the transducer and in turn provides an output signal sufficient to actuate a plurality of extinguishers. The repeater may have more than one input and provide an output to additional repeaters, to enable construction of a logic circuit such as shown in FIG. 1. The detailed construction of such a repeater is described below. However, in some circumstances the repeater will need only one input. In this case, the transducer illustrated in FIGS. 6 and 7 may be adapted to operate as its own repeater. A suitably modified transducer is shown in FIGS. 8, 9 and 10.

Figure 8:
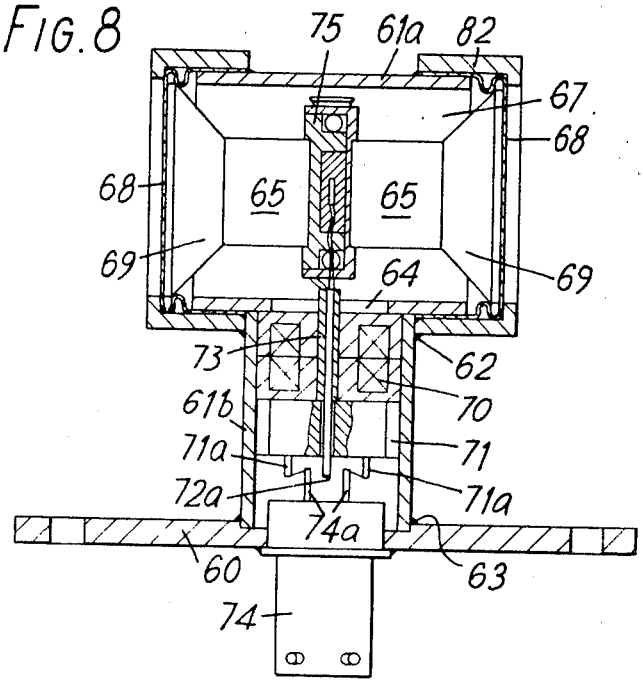
FIG. 8 is a sectional elevation of another embodiment of transducer for incorporation in a fire protection apparatus according to the invention, incorporating an integral repeater.
Figure 9:
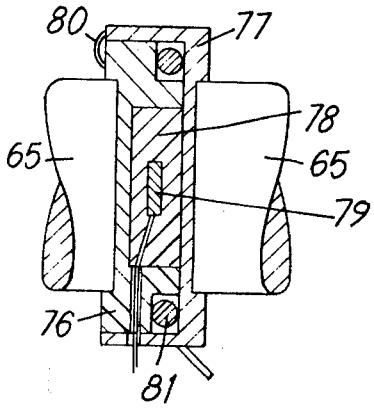
FIG. 9 is an enlarged view of part of FIG. 8.
Figure 10:
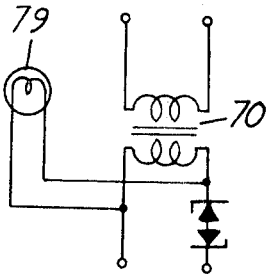
FIG. 10 is a circuit diagram of part of the transducer shown in FIGS. 8 and 9.

Referring to FIGS. 8, 9 and 10, the construction of the transducer is generally similar to that of FIGS. 6 and 7, and like parts are indicated with the same reference numerals and will not be referred to in greater detail. The transducer of FIGS. 8, 9 and 10 differs from that of FIGS. 6 and 7, in that the electrode plate 66 is replaced by a composite electrode 75. The electrode 75 comprises a pressure capsule formed by mating male and female portions 76 and 77, defining a chamber 78 containing a pressure generating explosuve charge. Within this explosive charge is arranged a detonator 79. The two halves 76 and 77 of the electrode 75 are relatively movable, and are bridged by an electrical conductor 80, to ensure that a reliable electrical connection is maintained therebetween. In the idle condition of the electrode 75, the chamber 78 formed between the two parts 76 and 77 is sealed by means of an annular pressure seal 81. A further difference from the transducer of FIG. 6 is that as shown in FIG. 8, the modified transducer is provided with annular end caps 82 overlying the diaphragms 68 and welded securely to the body 61 of the transducer, in order to prevent explosion of the transducer unit upon detonation of the explosive charge within the electrode 75. The circuit of the transducer shown in FIGS. 8 and 9 is indicated in FIG. 10, the primary winding of the transformer 70 being connected to the respective electrodes of the transducer as in the case of that shown in FIG. 6. However, the secondary winding of the transformer 70 is connected to the internal detonator 79, and in place of the diode bridge 71 there are provided a pair of Zener diodes 83 and 84, arranged in back to back configuration. The operation of the transducer illustrated is as follows. When a voltage is generated by the pressure wave acting on the transducer, the voltage pulse is transformed by the transformer 70 and fires the internal detonator 79. The two Zener diodes 83 and 84 have breakdown voltages higher than that required to fire the internal detonator 79, and thus the transducer circuit is effectively isolated from the remainder of the fire protection system until the detonator 79 is fired. Upon firing of the detonator 79 the pressure within the capsule 75 produced by the firing of the explosive charge causes the two halves 66 and 67 of the electrode 75 to expand relatively to one another and to apply a correspondingly high pressure to the respective piezo electric elements 65. The pressure upon the elements 65 is considerably greater than that due to the initial pressure wave within the liquid fuel, and thus a much greater voltage output is produced. The output voltage pulse passes via the transformer 70, exceeds the breakdown voltage of the Zener diodes 83 and 84, and thus provides an output voltage pilse at the transducer output. The transducer unit shown has the advantage that it may be tailored to any given conditions, since the sensitivity of the internal detonator 79 may be matched to correspond to the output voltage provided from the transducer as a result of the initial pressure wave within the liquid fuel, and the amount of the explosive charge within the electrode 75 may be adjusted to give the required output from the transducer elements 65. Since the transducer is required to give an amplified output once only, the pressure upon the elements 65 from the explosive electrode 75 may be such as to depole, or shatter the ceramics elements 65, in order to give a sufficiently high voltage output.

Figure 11:
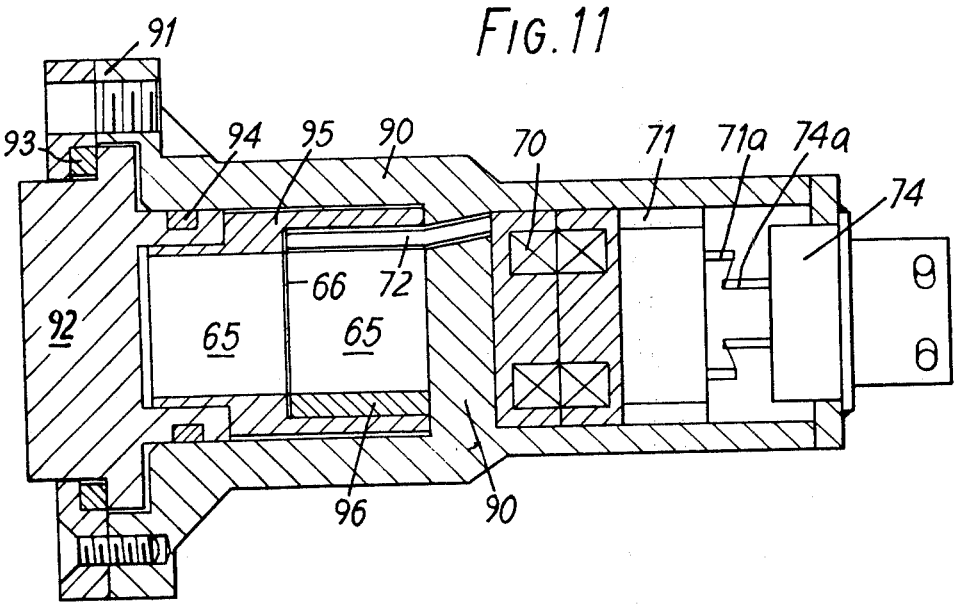
FIG. 11 is a sectional elevation of a further embodiment of transducer for incorporation in a fire protection apparatus according to the invention.

Referring now to FIG. 11, there is shown another embodiment of transducer unit for incorporation in a fire protection apparatus according to the invention, the unit being designed for use at the exterior of a fuel tank, instead of for immersion therein. Components which correspond with those of previously described embodiments of transducer unit are referred to by means of the same reference numerals and will therefore not be described again in detail. The transducer unit comprises an outer casing 90, provided with a mountinf flange 91 by means of which the unit may be assembled to the exterior wall of an aircraft fuel tank. A pressure sensing element 92 is arranged for axial sliding movement within the case 90, and located in position by toroidal rings 93 and 94. The member 92 is arranged to be held in close contact with the external skin of a fuel tank, so that pressure waves are transmitted between the liquid within the fuel tank and the member 92. Between the member 92 and an internal partition wall **90*a* of the casing 90 are arranged two cylindrical piezo-electric ceramic elements 65 of similar construction to those employed in the transducers described above. Between the elements 65 is also arranged the electrode disc 66. The elements 65 are located relatively to the casing 90 by means of insulating sleeves 95 and 96 respectively, the dimensions of the sleeves 95 and 96 being such as to permit axial compression of the ceramic elements 65 between the member 92 and the partition wall 90*a*. An insulated electrical conductor wire 72 is soldered to the electrode disc 66 and provides electrical connection between the latter and the pulse transformer 70. The casing 90 is arranged to house the pulse transformer 70, a rectifier diode bridge 71 and the output connector 74 in a similar manner to that described in the case of the previously referred to embodiments of transducer, these components likewise being connected to an electrical circuit as described above. In operation of the transducer device described, a pressure wave occurring within the fuel tank is transmitted to the outer skin thereof and the pressure wave is detected by the member 92 as a differential pressure between that within the fuel tank and atmospheric pressure. The corresponding axial movement of the member 92 transmits pressure to each of the piezo-electric elements 65, and thus generates a voltage across the electrodes defined by the disc 66 on the one hand and the member 92 and the partition 90***a* on the other. The operation of the transducer is otherwise as described above with reference to FIG. 6.

Figure 12:
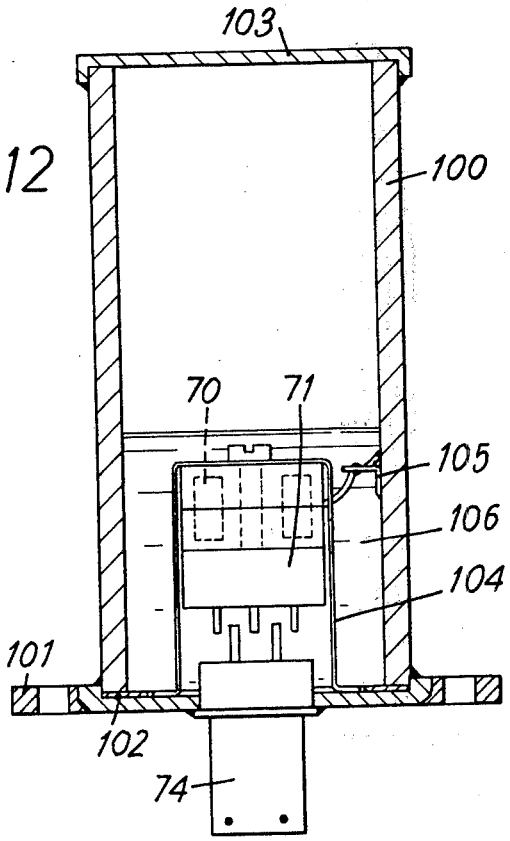
FIG. 12 is a sectional elevation of a yet further embodiment of transducer for incorporation in a fire protection apparatus according to the invention.

FIG. 12 shows a yet further embodiment of a transducer unit for immersion in a fuel tank, the pressure sensitive element of the transducer comprising a hollow cylindrical tubular piezo-electric ceramic element 100 which is radially polarized and provided with electrically conductive internal and external surfaces of suitably inert plating which act as the electrodes of the transducer. The element 100 is supported on a base member 101 providing a mounting flange for attachment to the base of a fuel tank skin. The element 100 is soldered or welded to the base member 101 at its outer silvered surface, and the end face of the element 100 is insulated from the base member 101 by means of an insulating ring 102. The upper end of the element 100 is closed by means of an end cap 103. A mounting frame 104 is secured to the base member 101, and extends within the element 100 to support a pulse transformer 70 and a rectifier diode bridge 71 similar to those described above. The components supported by the frame 104 are enclosed within a potting compound 106. The base 101 also supports an output connector 74. The elements 70, 71 and 74 are connected into a circuit with the element 100, in a similar manner to that described above. The connection is from the inner wall of the element 100 on the one hand, via terminal 105, and from the outer wall on the other, via its connection to the base member 101 and the frame 104. In this embodiment of transducer unit, a pressure wave within liquid fuel contained in a fuel tank is sensed as a radial compression of the hollow cylindrical element 100, and voltages are correspondingly derived at the inner and outer surfaces of the element. The operation of the transducer is otherwise as described above.

According to a modification (not illustrated) of the transducer shown in FIG. 12, the transducer may be confined with a capacitative sensor of a fuel gauge, in which case the capacitor of the fuel gauge is arranged coaxially within the cylindrical piezo-electric element, the latter being open at the top to accommodate the capacitor and having radial fuel drainage outlets at its base. The internal wall of the piezo-electric element will be acoustically shielded to permit the element to respond to a radial pressure difference upon the occurrence of shock waves with the fuel tank. Such an arrangement would have the considerable advantage that a single entry aperture at the base of the fuel tank could accommodate both the conventional contents gauge and the transducer of the system according to the invention. In addition the power supply that is required for the conventional fuel contents sensor could be made available to the transducer, for example to power a circuit such as that shown in FIG. 5.

As described above with reference to FIG. 1, in a preferred embodiment of fire protection system according to the invention, a transducer unit is used in conjunction with a repeater capable of providing a greater electrical signal output, so that a plurality of fire extinguishers may be actuated from a single transducer, the repeater having more than one input, to enable the connection of transducers and associated extinguishers in a logic circuit providing for selection of the most appropriate of a series of strategically located fire extinguishers for actuation in response to the output of any given transducer. The repeater units are self-powered in order to avoid dependence on the aircraft power supply for actuation of the fire protection system, and one embodiment of a self-powered repeater unti will now be described in more detail with reference to FIGS. 13 and 14 of the drawings.

Figure 13:
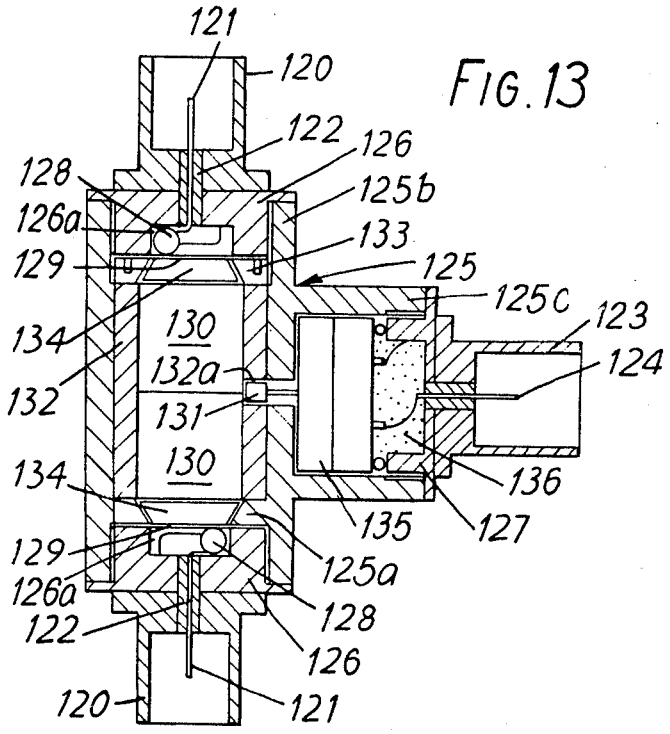
FIG. 13 is a sectional elevation of one embodiment of a repeater unit for incorporation in a fire protection apparatus according to the invention.
Figure 14:
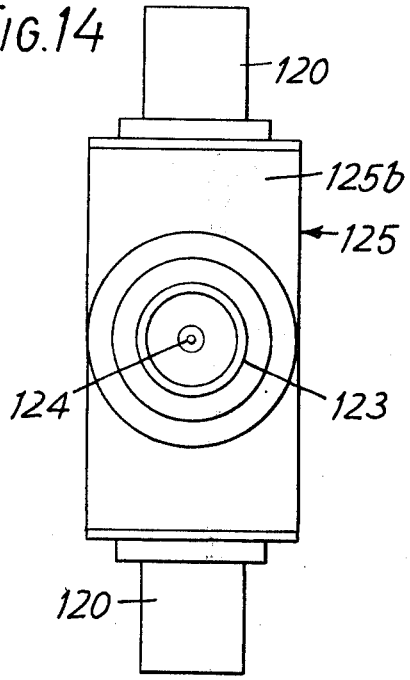
FIG. 14 is a side elevation of the unit shown in FIG. 13, in the direction of the arrow B.

Referring to FIGS. 13 and 14, the repeater unit there shown comprises input connector sockets 120 providing electrical input terminal connections via the casing of the socket 120 and a central conductor 121 insulated from the socket by means of an insulating sleeve 122. An electrical output is provided at a similar socket 123 via the socket housing and a conductor 124. The housing of the repeater unit is in the form of a T-piece 125, the sockets 120 being assembled to the ends of a cross-piece 125*b* of the housing by means of end plugs 126, and the socket 123 being likewise assembled to an end 125*c* of the housing by means of a plug 127. Within each of the plugs 126 is a recess 126*a* containing a detonator and explosive charge 128 electrically connected to the input terminals 120 and 121. Each of the recesses 126*a* is closed by means of a metal diaphragm 129 adhesively secured across the inner end of the plug 126 to form a gas type seal. Within the cross piece 125*b* are located two cylindrical ferro-electric elements 130, and the junction between the elements 130 is connected to a contact 131. The elements 130 are located within the cross-piece 125*b* by means of an insulating sleeve 132 having an aperture 132*a* for receiving the contact 131. The sleeve 132 is located between an internally projecting flange 125*a* at one end, and a disc 133 at the other end fitting closely between the sleeve 132 and the adjacent plug 126. The disc 133 is accurately dimensioned to take account of any manufacturing tolerances so that the components enclosed with the crosspiece 125*b* are firmly in contact with one another. At the outer end of each ferro-electric element 130 there is provided a metal cone 134, the cones 134 engaging within mating conical recesses provided in the flange 125*a* and the disc 133 respectively. The cones 134 are secured to the elements 130 by soft soldering. Within a chamber at the end 125*c* of the housing 125, thereiis provided a pulse transformer 135, the transformer 135 being surrounded within the chamber by a vibration proof potting compound 136. The primary winding of the transformer 135 is connected at one end o the contact 131, and at the other end to the housing 125, and the secondary winding of the transformer is connected to the terminals 123 and 124 of the output socket.

The operation of the repeater unit is as follows. Upon application of an input signal to either of the inputs of the repeater, via terminals 120 and 121, the explosive charge 128 is detonated and the gas pressure formed within the recess 126*a* is transmitted to the base of the adjacent metal cone 134, via the diaphragm 129. The metal cone 134 is therefore displaced from its seating to compress the ferro-electric elements 130 between itself and the corresponding cone 134 at the other end of the housing 125, the latter being held rigidly against displacement by means of its conical seating which is fixed with respect to the housing 125. The compression of the elements 130 causes a voltage to be produced between the cones 134 on the one hand, and the junction between the two elements 130 on the other, and this voltage is applied via the contact 131 and the housing 125 to the primary winding of the transformer 135. A corresponding output signal is derived from the transformer 135 at the terminals 123 and 124. It will be noted that whichever of the inputs of the repeater receives an electrical signal, the opposite input and the associated components remain unaffected by the pressure derived from the explosive charge, owing to the fact that the conical recess for the metal cone 134 prevents displacement of the latter in the direction of its seating. Thus after detonation of the explosive charge at one input of the repeater, the charge at the other input remains usable, and provided that the elements 130 are not destroyed by detonation of the first explosive charge, a second output signal can be derived from the device upon detonation of the second explosive charge. This feature may be utilised, for example in combination with a voltage or current responsive switching circuit connected at the output of the repeater, to provide successive output signals to different groups of extinguishers. To enable the same transducer to provide consecutive input signals to the two inputs of the repeater respectively, a changeover switch responsive to the output of the repeater, for example a known-type of explosive switch, may be connected between the transducer and the respective inputs of the repeater.

According to a modification, not illustrated, of the repeater shown in FIGS. 13 and 14, each of the chambers 26*a* may incorporate a plurality of detonators connected to separate input circuits. In this way a number of separate inputs to the same repeater may be isolated from one another. Although the repeater could respond only once, to the first one of the detonators operated, the isolation of the inputs could be of advantage in construction of a logic circuit requiring selective operation of different combinations of repeaters.

Figure 15:
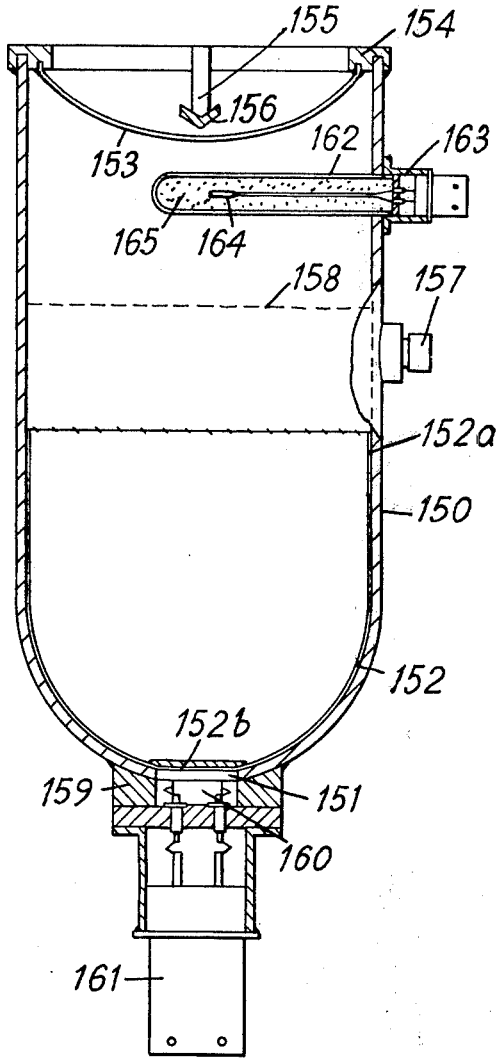
FIG. 15 is a sectional elevation of a fire extinguisher for incorporation in a fire protection apparatus according to the invention.
Figure 16:
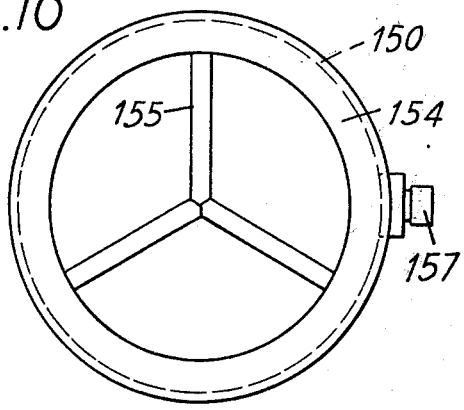
FIG. 16 is a plan view of the extinguisher shown in FIG. 15.

A fire extinguisher unit suitable for use in the fire protection system according to the invention is illustrated in FIGS. 15 and 16. The extinguisher comprises a generally cylindrical casing 150 having a generally hemispherical lower end. The lower end of the casing has an aperture 151, and the lower portion of the casing 150 is closed by means of a synthetic rubber membrane 152 lining the casing 150 and secured to the inner wall thereof at its upper end 152*a*. The membrane 152 has an area 152*b* of increased thickness overlying the aperture 151 and may also have an outer metal covering disc, for the purpose described below. The upper end of the casing 150 is closed by an outwardly concave metal diaphragm 153, seam welded to a metal rim 154 which is also welded to the upper end of the casing 150. The rim 154 also supports a three-armed spider member 155 extending within the upwardly concave metal diaphragm 153, and supporting a downwardly pointed stud 156 for penetration of the diaphragm 153 as described below. Below the diaphragm 153 is provided a thin walled metal tube 162 extending radially inwards from the casing 150. The outer end of the tube 162 is provided with an electrical connector 163, and the tube contains a detonator 164 wired to the connector 163, together with an explosive charge. The casing 150 also has a filler valve 157 by means of which a liquid extinguishant such as a mixture of BTM and BCF may be charged into the container to a liquid level 158. To the lower end of the casing 150 is welded a boss 159 defining a chamber 160 containing a detonator and gas generating explosive charge. The detonator is connected to the terminals of a hermetically sealed connector 161. The operation of the extinguisher is as follows. When an electrical signal is applied to the terminal of the connector 161, for example form a repeater unit as described above, the detonator and explosive charge within the chamber 160 is fired, causing generation of gas which issues from the aperture 151 into the casing 150 of the extinguisher. The gas generated is contained by the membrane 152 so that it does not merely explode through the liquid extinguishant, but builds up a pressure behind the membrane 152 which distributes the pressure over the body of liquid within the extinguisher. At the same time, a signal is applied to the terminals of the connector 163, which may for example be wired in parallel with the connector 161, so that the detonator 164 explodes the charge 165 and bursts the tube 162 to produce a pressure rupturing the diaphragm 153. The stud 156 therefore penetrates the diaphragm 153 and the diaphragm accordingly petals outwardly from the initial rupture point to permit discharge of the contents of the extinguisher. The arms of the spider 155 assist in defining the tearing points of the diaphragm 153, so that petalling outwards of the diaphragm is achieved in a regular and uniform manner. In addition, the diaphragm 153 may be pre-scored to define lines of weakness at which it will rupture.

From the above description it will be seen that there is provided a fire protection system which provides for actuation of strategically placed fire extinguishers in a logical and versatile manner ot achieve the maximum effect upon detection of penetration of a given fuel tank by a projectile, or of severe shocks from any other cause, the system remaining effective under extreme conditions owing to the self-energising nature of the system and the minimum reliance placed upon the power supply of the aircraft or other vehicle to which the system may be fitted.

Fire protection units in accordance with the invention are particularly suitabel in bays adjacent to aircraft fuel tanks when the bays are fairly large, e.g. more than half a cubic metre in capacity, such as are found around fuselage tanks. However, this simple, active self-powered unit proposed carries wide applications; it affords the opportunity of the retrofit and may be engineered to suit a wide range of tankage (integral/flexible) and may be used to discharge gas, liquid powder or chemical extinguishers. Although the fire protection apparatus has been described above specifically in relation to a Militery aircraft, it is of course equally applicable to Civil aircraft, for example in the case of penetration of fuel tanks by engine fragments such as impeller blades which may be thrown from an aircraft engine in the event of a malfunction. The fire protection apparatus described is particularly advantageous in that it provides extremely rapid response to pressure waves or shocks occurring within the fuel tank, providing for actuation of fire extinguishers within a matter of milliseconds. Thus, the system provides for effective fire prevention even before a fire can become established. Moreover, owing to the self-contained and self-powered nature of the system, the system is inherently logistics free, and requires a minimum of servicing. Should it be necessary to test the system, then this can be done by generating within the circuit of the system signals such as may be detected by appropriate test instruments, but which are not sufficient to cause response of a repeater unit. For example an ultrasonic signal could be injected into fuel contained within a fuel tank and the output of the transducer checked at an appropriate point in the circuit by means of a suitable test instrument.

A further advantage of the system is its inherent safety, there being no unit within an aircraft fuel tank which is itself capable of generating sparks such as might cause a fire. This is due to the fact that all wiring between transducers and the remainder of the circuit is normally arranged on the outside of any tank, the transducer within the tank being coupled to the circuit by means of a transformer. The use of transformer coupling of the transducer also enables the maximum advantage to be taken of the nature of the pressure wave occurring within a fuel tank, which is a repeated wave such as will produce a fluctuating or a.c. output from the transducer, the repeater being actuated by a component of the output signal from the transducer which exceeds a predetermined magnitude and/or a predetermined rate of increase.

Various modifications of the particularly described fire protection apparatus have already been referred to above, and it will be appreciated that many modifications may be made, or will become apparent to one skilled in the art, without departing from the scope of the invention as defined by the appended claims. For example, where axially polarized piezoelectric elements are employed in a transducer or repeater unit, it will be appreciated that instead of using a plurality of elements arranged end-to-end, as shown, a single element could be employed if desired. Also, in the case of a repeater unit, instead of providing a detonator arranged externally of a piezo-electric element, it would be possible to arrange a detonator within a hollow piezo-electric element, so that the whole of the energy generated by the detonator is absorbed by the piezoelectric element and a more efficient conversion of energy is obtained.

We claim:

1. Fire protection apparatus for use with a container of flammable liquid, the apparatus comprising of piezoelectric or magneto-strictive pressure transducer adapted to produce an operative electrical output upon sensing a pressure change of at least one of predetermined magnitude and predetermined rate, at least one repeater comprising a source of stored energy from which the stored energy is adapted to be released in response to said operative electrical output, and an actuator adapted to be operated by said repeater to effect discharge of fire extinguishant to resist combustion of said liquid, the transducer, the repeater and the actuator being operatively connected so that the repeater responds to the operative electrical output by releasing the stored energy and the actuator responds to the release of the stored energy by effecting discharge of fire extinguishant and wherein said repeater comprises a detonator and a transducer arranged to be energized by said detonator.

2. Fire protection apparatus for use with a container of flammable liquid, the apparatus comprising a piezoelectric or magneto-strictive pressure transducer adapted to produce an operative electrical output upon sensing a pressure change of at least one of predetermined magnitude and predetermined rate, at least one repeater comprising a source of stored energy from which the stored energy is adapted to be released in response to said operative electrical output and an actuator adapted to be operated by said repeater to effect discharge of fire extinguishant to resist combustion of said liquid, the transducer, the repeater and the actuator being operatively connected so that the repeater responds to the operative electrical output by releasing the stored energy and the actuator responds to the release of the stored energy by effecting discharge of fire extinguishant, and wherein a plurality of pressure transducers are arranged in parallel on a ring circuit arranged to feed a common repeater, each transducer being connected to said ring circuit via a diode rectifier bridge circuit, whereby said transducers are effectively isolated from one another.

3. Fire protection apparatus as claimed in claim 2, wherein each transducer is connected to the associated diode bridge circuit via a pulse transformer.

4. Fire protection apparatus for use with a container of flammable liquid, the apparatus comprising a piezoelectric or magneto strictive pressure transducer adapted to produce an operative electrical output upon sensing a pressure change of at least one of predetermined magnitude and predetermined rate, at least one repeater comprising a source of stored energy from which the stored energy is adapted to be released in response to said operative electrical output, and an actuator adapted to be operated by said repeater to effect discharge of fire extinguishant to resist combustion of said liquid, the transducer, the repeater and the actuator being operatively connected so that the repeater responds to the operative electrical output by releasing stored energy and the actuator responds to the release of the stored energy by effecting discharge of fire extinguishant and wherein the pressure transducer comprises a pair of axially polarized piezo-electric elements arranged end-to-end along their axis of polarization, a common electrode arranged between said elements, further electrodes in contact with the free ends of said elements, and a housing enclosing said elements and adapted to cause pressure changes externally of said housing to transmit axial stress to said piezo-electric elements whereby a voltage is produced across the respective electrodes in contact with each element.

5. Fire protection apparatus as claimed in claim 4, wherein said further electrodes are electrically connected together via said housing.

6. Fire protection apparatus as claimed in claim 4, wherein said housing comprises of rigid open-ended tubular portion extending axially around said piezoelectric elements, and flexible diaphragms closing the open ends of said tubular portion and located in electrical and pressure contact with said free ends of said piezo-electric elements.

7. Fire protection apparatus as claimed in claim 6, further comprising pressure intensifier studs arranged between said diaphragms and said piezo-electric elements, said studs being formed of electrically conductive material and having surfaces of larger surface area in contact with said diaphragms and surfaces of smaller surface area in contact with said piezo-electric elements and serving as said further electrodes.

8. Fire protection apparatus as claimed in claim 4, wherein said housing comprises a rigid tubular portion extending axially around said piezo-electric elements, a transverse partition rigid with respect to said tubular portion and engaging the free end of one of said elements, and a member axially movable with respect to said rigid tubular portion and engaging the free end of the other of said elements, said tubular portion of the housing being adapted for attachment to the outer surface of a fuel tank whereby the said axially movable member is in contact with the tank wall and flexing of said wall due to pressure waves in liquid contained thereby transmits axial movement to said member to stress said piezo-electric elements.

9. Fire protection apparatus for use with a container of flammable liquid, the apparatus comprising a piezo-electric or magneto-strictive pressure transducer adapted to produce an operative electrical output upon sensing a pressure change of a least one of predetermined magnitude and predetermined rate, at least one repeater comprising a source of stored energy from which the stored energy is adapted to be released in response to said operative electrical output, and an actuator adapted to operated by said repeater to effect discharge of fire extinguishant to resist combustion of said liquid, the transducer, the repeater and the actuator being operatively connected so that the repeater responds to the operative electrical output by releasing the stored energy and the actuator responds to the release stored energy by effecting discharge of fire extinguishant, and wherein said repeater is combined with said transducer and comprises a detonator adapted to apply pressure to a pressure sensitive element of said transducer when fired by an output signal therefrom, whereby an initial signal from said transducer is thereby intensified to a level capable of operating said actuator.

10. Fire protection apparatus as claimed in claim 9, wherein said actuator is isolated from the output of said transducer by means adapted to become electrically conductive at a predetermined threshold voltage greater than that required to fire said detonator.

11. Fire protection apparatus as claimed in claim 10, wherein said isolating means comprises a pair of Zener diodes connected in series bact-to-back.

12. Fire protection apparatus for use with a container of flammable liquid, the apparatus comprising a piezo-electric or magneto-strictive pressure transducer adapted to produce an operative electrical output upon sensing a pressure change of at least one of predetermined magnitude and predetermined rate, at least one repeater comprising a source of stored energy from which the stored energy is adapted to be released in response to said operative electrical output, and an actuator adapted to be operated by said repeater to effect discharge of fire extinguishant to resist combustion of said liquid, the transducer, the repeater and the actuator being operatively connected so that the repeater responds to the operative electrical output by releasing the stored energy and the actuator responds to the release of the stored energy by effecting discharge of fire extinguishant and wherein said pressure transducer comprises a hollow cylindrical element of piezo-electric material polarized radially with respect to the cylinder, at least one end of said cylindrical element arranged to extend within said container being closed, and the inner and outer walls of said cylinder being covered with electrically conductive material forming the electrodes of the transducer.

13. Fire protection apparatus for use with a container of flammable liquid, the apparatus comprising a piezo-electric or magneto-strictive pressure transducer adapted to produce an operative electrical output upon sensing a pressure change of at least one of predetermined magnitude and predetermined rate, at least one repeater comprising a source of stored energy from which the stored energy is adapted to be released in response to said operative electrical output and an actuator adapted to be operated by said repeater to effect discharge of fire extinguishant to resist combustion of said liquid, the transducer, the repeater and the actuator being operatively connected so that the repeater responds to the operative electrical output by releasing the stored energy and the actuator responds to the release of stored energy by effecting discharge of fire extinguishant, wherein amplifying means are provided for amplifying said operative electrical output and wherein said repeater comprises a plurality of separately operable detonators all adapted to act upon a common transducer to provide an output signal.

14. Fire protection apparatus as claimed in claim 13, wherein said repeater comprises a plurality of ferro-electric elements arranged end-to-end, a pair of electrically connected electrodes located at the free ends of said elements, a contact connected to a junction between adjacent ones of said ferro-electric elements whereby upon axial compression of said elements an output signal is generated between said electrodes on the one hand and said contact on the other hand, and a detonator arranged adjacent each electrode whereby upon firing of each of said detonators the ferro-electric elements are subjected to axial compression.

15. Fire protection apparatus as claimed in claim 14, wherein each of said electrodes of said repeater comprises a frustoconical disc of which the wider part is in contact with a corresponding one of said ferro-electric elements and the conical part engages a mating seating restraining said disc from axial movement away from the adjacent ferro-electric element, whereby each disc is capable of axial movement away from its seating by the adjacent detonator to effect compression of said ferro-electric elements, but resists axial pressure due to movement of the opposite disc.

16. Fire protection apparatus for use with a container of flammable liquid, the apparatus comprising a piezo-electric or magneto-strictive pressure transducer adapted to produce an operative electrical output upon sensing a pressure change of at least one of predetermined magnitude and predetermined rate, at least one repeater comprising a source of stored energy from which the stored energy is adapted to be released in response to said operative electrical output and an actuator adapted to be operated by said repeater to effect discharge of fire extinguishant to resist combustion of said liquid, the transducer, the repeater and the actuator being operatively connected so that the repeater responds to the operative electrical output by releasing the stored energy and the actuator responds to the release of the stored energy by effecting discharge of fire extinguishant, and including a fire extinguisher comprising a generally cylinderical container containing extinguishant, an actuator arranged at one end of said container and comprising a detonator and gas generator for pressurizing said container in response to a signal from the or a said repeater, and a diaphragm closing the other end of said container and arranged to be ruptured by the gas pressure generated within said container to discharge the contents, said fire extinguisher further comprising a flexible membrane adapted to contain gas generated by said gas generator at least during initial pressurization of said container, and wherein said container comprises an outwardly convex hemispherical end portion lined by said membrane, and an aperture at the center of said hemispherical portion and communicating with said gas generator, the portion of said membrane overlying said aperture being reinforced to resist the initial blast from the gas generator.

17. Fire protection apparatus comprising a first transducer adapted to generate an operative electrical output in response to conditions indicative of a fire hazard, a repeater comprising a source of stored energy, means responsive to the operative electrical output of the first transducer for releasing the stored energy, a second transducer adapted to produce, in response to release of the stored energy an electrical output of greater energy than that of the first transducer and at least one electrically operable actuator for effecting discharge of fire extinguishant, the first transducer, the repeater, the transducer operative electrical output responsive means, the second transducer and the actuator being operatively connected so that the means responsive to the operative electrical output of the first transducer receives said operative electrical output and thereupon releases the stored energy from the repeater, the second transducer is energized by the release of the stored energy to produce an electrical output of greater energy than that of the first transducer and the actuator for effecting discharge of fire extinguishant receives said greater energy electrical output and thereupon effets discharge of fire extinguishant.

18. Fire protection apparatus for use with a container of flammable liquid, the apparatus comprising a piezoelectric or magneto-strictive pressure transducer adapted to produce an operative electrical output upon sensing a pressure change of at least one of predetermined magnitude and predetermined rate, at least one repeater comprising a source of stored energy from which the stored energy is adapted to be released in response to said operative electrical output, and an actuator adapted to be operated by said repeater to effect discharge of fire extinguishant to resist combustion of said liquid, the transducer, the repeater and the actuator being operatively connected so that the repeater responds to the operative electrical output by releasing the stored energy and the actuator responds to the release of the stored energy by effecting discharge of fire extinguishant, amplifying means being provided for amplifying said operative electrical output, said amplifying means comprising an enhancement field effect transistor of the type which remains nonconductive in the absence of a signal at a gate electrode thereof and a storage capacitor connected to a power source via an isolating diode for retaining a charge in a circuit including said enhancement field effect transistor and the or each said repeater, the enhancement field effect transistor being arranged to be triggered to a conductive state by an output from said transducer which exceeds a predetermined threshold value.

* * * * *